US010995515B2

(12) United States Patent
Zingerle

(10) Patent No.: US 10,995,515 B2
(45) Date of Patent: May 4, 2021

(54) SUPPORTING FRAMEWORK AND STABILIZER DEVICE FOR A TENT

(71) Applicant: Zingerlemetal AG, Natz/Schabs (IT)

(72) Inventor: Georg Zingerle, Natz/Schabs (IT)

(73) Assignee: ZINGERLEMETAL AG, Natz/Schabs (IT)

( * ) Notice: Subject to any disclaimer, the term of this patent is extended or adjusted under 35 U.S.C. 154(b) by 0 days.

(21) Appl. No.: 16/044,038

(22) Filed: Jul. 24, 2018

(65) Prior Publication Data

US 2019/0024403 A1 Jan. 24, 2019

(30) Foreign Application Priority Data

Jul. 24, 2017 (DE) ..... 10 2017 116 674.2
Jul. 24, 2017 (DE) ..... 20 2017 104 407.6

(51) Int. Cl.

| | |
|---|---|
| ***E04H 15/50*** | (2006.01) |
| ***E04B 1/344*** | (2006.01) |
| *E04H 15/46* | (2006.01) |
| *E04H 15/60* | (2006.01) |
| *E04H 15/26* | (2006.01) |

(52) U.S. Cl.

CPC ..... *E04H 15/50* (2013.01); *E04B 1/3441* (2013.01); *E04H 15/26* (2013.01); *E04H 15/46* (2013.01); *E04H 15/60* (2013.01)

(58) Field of Classification Search

CPC ..... E04H 15/26; E04H 15/322; E04H 15/50
See application file for complete search history.

(56) References Cited

U.S. PATENT DOCUMENTS

| | | | | |
|---|---|---|---|---|
| 5,274,980 | A * | 1/1994 | Zeigler | E04H 15/50 135/123 |
| 5,490,532 | A * | 2/1996 | Mallookis | E04H 15/50 135/114 |
| 7,240,686 | B2 * | 7/2007 | Seo | E04H 15/50 135/131 |
| 7,422,026 | B2 * | 9/2008 | Kim | E04H 15/50 135/120.2 |
| 8,220,477 | B2 * | 7/2012 | Park | E04H 15/50 135/131 |
| 2002/0074032 | A1 * | 6/2002 | Park | E04H 15/50 135/131 |
| 2008/0017232 | A1 * | 1/2008 | Zeigler | E04H 15/50 135/131 |

(Continued)

FOREIGN PATENT DOCUMENTS

| | | | | |
|---|---|---|---|---|
| CN | 204370900 U | * | 6/2015 | |
| DE | 202004016429 U1 | * | 12/2004 | E04H 15/50 |

*Primary Examiner* — David R Dunn
*Assistant Examiner* — Danielle Jackson

(57) ABSTRACT

Supporting framework of a tent with a roof having a pyramid shape, a supporting structure comprising at least four supports, at least three outer scissor-type grid sections for each outer side of the supporting framework, a device for attaching the roof to the central post, central diagonal bars extending from the central post, wherein the central diagonal bars are connected to the outer scissor-type grid sections via scissor-type grid sections directed inwards into the tent, and wherein the central post is extended by means of a handling bar—for the formation of the apex of the roof, and wherein the handling bar or the central post can be connected to the central diagonal bars.

12 Claims, 9 Drawing Sheets

(56) References Cited

U.S. PATENT DOCUMENTS

| | | | | |
|---|---|---|---|---|
| 2015/0247339 | A1* | 9/2015 | Lee | E04H 15/50 135/145 |
| 2015/0308147 | A1* | 10/2015 | Lee | E04H 1/1205 135/145 |
| 2015/0376913 | A1* | 12/2015 | Choi | E04H 15/50 135/147 |
| 2016/0002949 | A1* | 1/2016 | Yang | E04H 15/46 135/139 |
| 2016/0348392 | A1* | 12/2016 | Jin | E04H 15/50 |
| 2016/0348395 | A1* | 12/2016 | Jin | E04H 15/50 |
| 2019/0338552 | A1* | 11/2019 | Jun | E04H 15/46 |

* cited by examiner

SUPPORTING FRAMEWORK AND STABILIZER DEVICE FOR A TENT

RELATED DOCUMENTS

This application claims priority to German Patent Application No. 10 2017 116 674.2, filed Jul. 24, 2017, and titled SUPPORTING FRAMEWORK AND STABILIZER DEVICE FOR A TENT, and claims priority to German Patent Application No. 20 2017 104 407.6, filed Jul. 24, 2017, and titled SUPPORTING FRAMEWORK AND STABILIZER DEVICE FOR A TENT, all of which are incorporated by reference in their entirety herein.

BACKGROUND

The present invention relates to a supporting framework and a stabilizer device for a tent according to the preamble of patent claims 1 and 10 as well as a tent according to claims 11 and 12.

A tent is known from DE 10 2011 054 205 B4 which has a skin and a framework covered at least partially by the skin in the set-up state of the tent. The skin is the term used to describe the fabric material of the tent roof.

The tent has a plurality of ridge elements connected to a common center piece as well as a plurality of post elements. In the set-up state of the tent, the post elements are placed on one level.

Generally, tents have four vertical corner supports, which serve to support the supporting framework, i.e. the overall static system of the supporting members which are decisive for the stability of the structure, and, in combination with the supporting framework, the tent roof.

For this purpose, the corner supports are connected to each other, with the connection also running crosswise. These connections include profile elements, which are today commonly commercially manufactured from aluminum and configured in the form of bar profiles.

Tents are often configured in the form of folding tents. In order to be opened and closed for this purpose, profile elements configured in the form of scissor-type profiles or scissor-type grid profiles, which are part of the supporting framework of the tent, extend from the corner supports. Such scissor-type profiles are also used for tents which are not configured in the form of folding tents. Here, the terms scissor-type grid profile and scissor-type profile are used synonymously.

Pagoda tents are a particular configuration of tents and commonly have a square floor plan. The square floor plan is often 4×4 m, 5×5 m, 6×6 m, 7×7 m etc.

In comparison to classic tents, in particular folding tents, and pavilions, pagoda tents with their high, pointed roofs look lighter and more elegant. A further advantage is that due to the high and pointed roof, rainwater runs off evenly on all four sides and ponding of rainwater can be avoided. In addition, heat cannot accumulate under the pointed roof as easily as under a flat roof.

In the case of larger tents, the aforementioned profile elements or scissor-type profiles are connected to at least one connecting element arranged on the long and/or wide side of the outer supporting structure.

A support of the connecting element on the long sides of the tent by means of a supporting element or a supporting strut, as for example in the case of the aforementioned corner supports, is often avoided, because such a supporting element or such a supporting strut is considered to be optically disturbing and impairs access to the inside of the tent.

Depending on the number of profile elements to be connected, the connecting element usually has an elongated, T-shaped or cross-shaped configuration. It also serves to receive a scissor-type profile performing functions towards the inner area of the tent roof.

A tent arrangement comprising a fabric of a tent roof held by a supporting structure is known from the German utility model DE 20 2004 016 429 U1, which was registered by the applicant. This structure comprises circumferential tubular holding elements having a tent roof supporting structure in the shape of a scissor-type grid, also of a foldable type, and supporting the latter. The internal supporting structure, i.e. the structure forming a framework, in turn has at least one supporting element, which is referred to below synonymously as central post or central pole, which is directed towards the fabric of the tent roof and holds it directly so that the fabric is for the most part located away from the tent roof supporting structure having the shape of a scissor-type grid and forms a typical cone-shaped tent roof structure. A device is connected to the central post or the central pole which serves to firmly attach the fabric of the tent roof to the central post or the central pole. In addition, the device serves to allow a pole, for example for an advertising flag, to be connected to the supporting structure. If the fabric of the tent roof has a plurality of central posts or central poles connected to the supporting structure, each central post equipped with a device or each central pole can be connected to a pole.

The aforementioned utility model also describes a mushroom-shaped sealing of the apex of the tent roof in relation to the pole, which holds an advertising flag in this embodiment. The present application adopts the disclosure content in this respect. By way of example, but not by way of limitation, it is based on a basic framework structure of a tent roof, as is shown in particular in FIG. 5 of this utility model.

Tents other than folding tents have to be assembled or screwed together in a time-consuming and thus cost-intensive manner, especially with regard to their supporting framework. This applies in particular to tents which exceed specific floor plan dimensions, for example tents exceeding square floor plan dimensions of 4×4 m. This applies to tents irrespective of their geometrical roof shapes and thus irrespective of whether they are pagoda tents, tents with a low cone shape or the like.

Tents exceeding specific dimensions can no longer be transported in the folded state by means of a passenger car or a station wagon, or, for example, their corner supports have to be divided into so many part sizes that, although they make such a tent suitable for transport, they make the setting up of the tent more time-consuming and, above all, lead to a reduction in stability. This will be briefly explained below with reference to a tent having a square floor plan of 5×5 m:

Such a tent with a square floor plan of 5×5 m has an overall height or packing height of 2.50 m in the closed state, because it has two scissor-type profiles which are opened when the tent is set up. This means that the scissors then also have a length of 2.50×2.50 m. An overall height of 2.50 m results in cumbersome handling when transporting a folded tent in a passenger car or a station wagon.

In the case of the tent with a square floor plan of 5×5 m, as explained by way of example, it is out of the question to reconfigure the double scissor-type profile arrangement of 2×2.50 m into a scissor-type profile arrangement consisting of three scissor-type grid profile sections with a length of approx. 1.66 m (in the following: approx. 1.70 m). This is because the supporting framework of a tent does not only consist of such scissor-type grid profiles running laterally around the outer edge of the supporting framework. Rather, they must also have connections directed towards the inner area of the supporting framework, which converge in a central pole, which in turn supports the apex of the tent roof fabric. This is because such a division into three scissor-type grid sections of approx. 1.70 m in length results in a total of nine partial square areas for a tent with a square floor plan of 5×5 m if additional profile elements extend from the end points of the scissor-type grid profiles and from each of the four sides of the supporting framework at right angles and run towards the inside of the tent. This means that a center or junction point of the tent formed by the same scissor-type grid sections is missing, i.e. these profiles branching off from the scissor-type grid sections and being directed into the inside of the tent do not run towards a central post arranged in the middle of the tent and receiving the apex of the tent roof.

Based on these drawbacks of the state of the art, the technical problem of the present invention is therefore to develop a tent which has a lower packing height or overall height compared to the state of the art.

This also involves the further problem of developing a supporting framework of a tent which has more than two scissor-type grid sections running circumferentially on each outer side of the supporting framework, and in which the profile elements of the supporting framework nevertheless run towards a center or junction point configured in the form of a central post arranged in the middle of the tent and receiving the apex of the roof.

In addition, a supporting framework of a tent is to be provided which avoids a time-consuming and cost-intensive assembling or screwing together of its individual profile elements when the tent is set up.

Furthermore, a supporting framework is to be provided which, despite its reduction in packing height/overall height in the folded state, enables a roof structure which has a high and relatively pointed roof, i.e. a roof which is commonly referred to as pagoda roof.

A further sub-problem is the aim of providing improved stability of a supporting framework structure for tents with larger floor plans, i.e. floor plans exceeding 4×4 m in square or 3×4 m in rectangular form.

These problems are solved by a supporting framework having the features of claim 1. Advantageous embodiments are laid down in the sub-claims. A tent according to the invention is described in claim 12.

SUMMARY

Accordingly, the supporting framework of a tent has a roof with a pyramid shape and comprises a supporting structure with at least four supports, at least three scissor-type grid sections for each outer side of the supporting framework, at least two scissor-type grid sections, each of which branches off from the three scissor-type grid sections for each outer side of the supporting framework at an angle towards the inside of the tent, at least four inner scissor-type grid sections, which are connected to the ends of the respectively at least two scissor-type grid sections, and which run parallel to the at least three scissor-type grid sections running circumferentially around the outer sides, with a device for fastening the roof to a central post, with central diagonal bars extending from the central post, wherein the central post is extended by means of a handling bar for the formation of the apex of the roof and the handling bar or the central post is connected to the central diagonal bars.

In the present case, a tent is understood to be a temporary, simple and preferably portable construction.

Tents within the meaning of the invention comprise inter alia "classic" tent configurations, folding tents, rescue tents, beer tents, kiosks, storage tents, event tents, pavilions, scissor-type tents, quick pitch tents, sales stands, promotion stands, bar pavilions, pagoda tents, tents for "tent cities". For example, they can have square, rectangular, hexagonal, octagonal floor areas. They can be set up and/or taken down with or without tools at almost any location. They may also be intended for permanent use.

A tent is characterized in that it consists inter alia of a framework made of profile elements and a roof placed above it. The profile element framework, which is configured in some areas in the form of a scissor-type grid section, is part of the supporting framework. A scissor-type grid section has two profile elements crossing each other when pulled apart.

Supporting framework within the meaning of this invention is the term used to describe the overall static system of the roof structure of a tent. It comprises inter alia profile elements and profile supports as a support system for the tent roof, connecting elements for the connection of the profile supports and profile elements, bolted joints, flanges.

Aluminum is mainly used for the profile elements and the profile supports, but other metal and plastic materials or wood can be also used.

Fabric of the tent, in particular the tent roof, is understood to mean any material used for tents, for example reinforced vinyl, cloth, polyester, PVC, nylon, polyurethane, impregnated fabrics, plastic foils or mixed fabrics.

In recent times, so-called folding tents, which are also referred to as quick pitch tents, have become more and more important. Their advantage lies in the fact that they are mainly delivered with the roof already assembled, that it is not necessary to dismantle the roof when setting up and taking down the folding tent, and that the setting up and dismantling can usually also be carried out without tools. The present invention is specifically designed for this type of folding tent.

Such folding tents are folded in the delivery state. When the tent is set up, a structure opens up as a result of the tent being pulled apart above scissor-type grid profiles arranged on the outer sides of the supporting framework and running circumferentially around it. The pre-assembled roof is tensioned automatically. For this purpose, the corner supports of the tent are therefore connected to a roof structure having the shape of a scissor-type grid, which enables the tent to be pulled apart when being set up. Regardless of the respective configuration of a tent, the tent roof usually rests on the ends of the supports which are at the top in the set-up state, in particular on the corner supports arranged at the corners of the tent roof, and spans them. Additional supports, for example in the middle of the tent or on the long sides or front sides of the tent, may be provided.

If the tent has a rectangular or square floor plan, it has at least four profile supports. A polygonal tent has a corresponding plurality of supports.

As a synonym for the term "profile support" used here, the terms "corner support", "support leg", "corner post" or the like can also be used.

The profile supports in turn can be arranged on the bottom side in separate feet, which is particularly suitable when setting up a tent on a lawn, the ground, sand or the like.

The geometrical configuration of the respective profile support is basically of no importance. Within the scope of the present invention, an octagonal configuration of a support in the form of a hollow profile is assumed merely by way of example, i.e. without being limited thereto.

The outer wall of the support can be smooth, ribbed, corrugated or have any other desired configuration.

The roof structure of the tent rests on the end of the supports which is at the top in the set-up state of the tent. In the case of a square tent structure, the four respective corner areas of the tent roof are therefore disposed on the supports correspondingly arranged in a square. A connection between the supports and the corner areas of the tent roof is preferably made in the form of a hinged connection. However, the latter is not the subject matter of the present invention.

The supports are connected to each other circumferentially on the outer sides, preferably by means of scissor-type grid sections via connecting elements connecting these scissor-type grid sections. At least three scissor-type grid sections run on each of the outer sides of an exemplary square tent structure according to the invention. The scissor-type grid sections can also be synonymously referred to as profile elements. The supports are thus connected to each other by means of profile elements. The profile elements, i.e. the scissor-type grid sections running circumferentially around the outer sides of the supporting framework, in turn can be connected to each other by means of one or more connecting elements. Therefore, if three scissor-type grid sections are arranged on one side, at least two connecting elements are provided for connecting the scissor-type grid sections to each other.

With regard to the material and constructional, geometrical configuration of the profile elements, the corresponding explanations on the profile supports apply analogously, provided that the profile elements serve the use for the tent roof-related portion of the supporting framework.

When looking at one side of the supporting framework according to the present invention, each of its outer corners has a corner support. The corner supports are connected to each other by means of at least three scissor-type grid sections. The corner support which is on the left when viewed from the front is first connected to the adjacent scissor-type grid section by means of a connecting element. This connecting element preferably has an L-shape, because it also serves as a connection to the other adjacent corner support. The aforementioned scissor-type grid section is then followed by a second scissor-type grid section, with the connection of these two sections in turn being made by means of a connecting element having a T-shape in a preferred embodiment. The third scissor-type grid section is arranged adjacent thereto, which in turn is connected to the second scissor-type grid section by means of a preferably T-shaped connecting element. Then the third scissor-type grid section in turn is connected to the corner support which is on the right when viewed from the front by means of a further connecting element preferably having an L-shape.

These at least three scissor-type grid sections running circumferentially around the outer sides are also referred to below as outer scissor-type grid sections.

Viewed individually, each side of the supporting framework thus has at least four upper connecting elements.

Since this is a scissor-type grid structure, a corresponding number of lower connecting elements is added, because the connecting elements are arranged at the point where one scissor-type profile has its maximum spacing of its profile elements in height and is attached to the adjacent scissor-type profile, where this scissor-type profile also has its maximum distance in its connecting area. Here, this maximum distance is abbreviated with "d".

These connecting elements are inter alia required in cases where the profile elements have to bridge larger or large distances from the supports.

On the one hand, the connecting elements used within the scope of the invention preferably have a T-shaped receiving structure for the connection of preferably two profile elements, with the profile elements in the shape of a scissor-type grid running essentially parallel to the respective side of the tent, while at least one further profile element branches off from these scissor-type grid arrangements towards the inside of the tent. The connecting elements are thus not aligned with a two-dimensional course, which would be sufficient for a connection of the scissor-type grid sections to each other, but they preferably have a receiving structure branching off therefrom at a right angle, which receives the profile element running towards the inside of the tent. This connector described above is therefore also referred to below as three-way connector. This is because the supporting framework according to the invention preferably has at least two scissor-type grid sections of the at least three scissor-type grid sections running on the respective outer side of the supporting framework, which are adjacent to each other on each outer side of the supporting framework and branch off at a preferentially right angle towards the inside of the tent. They preferably run parallel to each other. These scissor-type grid sections also consist of profile elements.

As these at least two scissors-type grid sections leading towards the inside of the tent branch off from all four outer sides of the supporting framework, they run towards each other inside the tent.

They are also referred to below as directed or running inwards into the tent.

At the point where the scissor-type grid sections directed inwards into the tent run towards each other, i.e. at their ends located inside the tent, connecting elements are installed. Preferably, these connecting elements are so-called four-way connectors.

Firstly, these four-way connectors connect the scissor-type grid sections directed inwards into the tent, i.e. at the point where the scissor-type grid sections each arranged adjacent to each other run towards each other in a crosswise manner. Secondly, as a kind of junction point, these connectors also receive—in the case of a tent with a square or rectangular floor plan—a set of four inner scissor-type grid sections running circumferentially in a rectangular manner. These inner scissor-type grid sections, which are also referred to below as such, in turn are connected to each other at their respective ends by means of the four-way connectors.

This arrangement of the inner scissor-type grid sections thus results in a kind of square in plan view. In the center of the square, the central post of the tent is arranged, which in turn is connected via diagonally running profile elements extending therefrom to the portion of the tent roof-related supporting framework with scissor-type grid sections described above. The connection is made by means of the four-way connectors described above or by any other hinge or attachment to junction points of the scissor-type grid sections directed inwards into the tent and the inner scissor-type grid sections as described above. The diagonally running profile elements are also referred to below as central diagonal bars.

The structure of the supporting framework described above, on which further explanations are given below, results in a segmentation of the tent roof-related supporting framework which is ninefold in the tent configuration described above and in the center of which the central post of the tent is located. The structure of the connection between the central post and the supporting framework described above provides a stable overall structure, which is perfectly suitable for the aforementioned types of tent roofs.

Since the scissor-type grid sections described above are connected to each other at their respective ends via the connecting elements, it is preferable that upper and lower connecting elements each are provided in the three-way or four-way connector configuration described above. The upper connecting element receives the profile element directed upwards, and the lower connecting element receives the profile element of the respective scissor-type grid section directed downwards.

Instead of a separate upper and lower connecting element, it is also possible to provide a one-piece connecting element combining the functions of both elements.

The profile element used in each case can therefore have a corresponding receiving structure for two profile elements, i.e. an L-shaped, Z-shaped or, for example, a longitudinal receiving structure. For use inside the tent, for example, the connecting element can also have a receiving structure for four profile elements similar to a so-called hash key on a telephone keyboard; such a connecting element is often referred to as four-way connector.

Further receiving structures are possible and are left to the discretion of the person skilled in the art depending on the specific intended use.

The scissor-type profile comprises profile elements extending to each at an angle other and hinged together, which are brought into contact with each other substantially vertically in a folded state.

In the set-up state, in which the tent roof rises in its highest elevation above the supports of the supporting framework of the tent, the profile elements extend in a scissor shape beneath the tent roof.

The supporting framework arranged inside the tent, i.e. the roof structure of the tent, in turn has at least one central post, which has an indirect support in the roof structure as explained above. The tent roof can have a plurality of such central posts, which are part of the supporting framework. The central post is preferably hollow, at least partially hollow.

The central post is directed towards the fabric of the tent roof and holds it directly so that the apex of the tent roof fabric is located as far away as possible from the remaining structure of the supporting framework. This results in the typical cone-like or pagoda-like tent roof structure.

A device, which serves to firmly connect the fabric of the tent roof to the central post, is connected to the central post.

This device preferably has a closing mechanism on the upper front side of the apex of the tent roof in order to seal this area in a watertight manner.

The device comprises a first body, which serves to be connected to the central post, and a second body, which serves to be connected to the first body. The latter directly holds the fabric of the tent roof, which is inserted between the two bodies. For the connection between the two bodies, the fabric of the tent roof has an opening, which is preferably surrounded by a rigid ring bordering the edge of this opening. This ring is thus inserted between the aforementioned bodies in such a manner that a connection between them is made possible. However, other related structures are easily possible for the person skilled in the art.

In particular, the first body has a substantially mushroom-shaped form and comprises a vertically running wall, which preferably has a tubular configuration and surrounds a hollow space. The first body serves to be fitted into the central post and to be inserted into its hollow space by means of the wall of the tube. An inverse configuration is also possible. The first body can be pulled out of the central post again.

After the first body has been inserted into the central post, the ring of the fabric of the tent roof slides over the head of this body. The ring rests, in particular, on the flat portion of the head.

The first body is connected to the second body, which also has a substantially mushroom-shaped configuration. The second body also comprises a vertically running wall of a tube surrounding a hollow space.

At the head end of the wall of the tube of the second body, a cylinder cap is arranged, which serves to cover the ring of the fabric of the tent roof and to interact with a lid in a manner known per se so as to close the hollow space inside the second body. Thus, this lid also serves indirectly to close the hollow space of the central post when it is in a state of non-use, for example, so that rain, dust or other substances cannot penetrate into the hollow space.

If required, a further component, for example a pole, which receives a rotatable object or an advertising banner, can be placed, for example inserted, into the hollow space.

The connection between the first body and the second body is made by inserting the latter into the hollow space of the former, as is described, for example, in detail in the German utility model DE 20 2004 016 429 U1 mentioned to above. The connection between the bodies is reversible so that they can be separated by pulling them out.

As described above, the device can also serve to allow the further component, for example the pole, which receives the rotatable object, to be connected to the supporting structure, in particular the central post. If the roof structure has a plurality of supporting elements having the function of central posts connected to the supporting structure of the supporting framework, each supporting element or a plurality of them may be equipped with a device which connects a further component receiving the rotatable object to the central post.

The essential point about a folding tent is that due to the aforementioned structure, the roof can be penetrated from above with the further component, which receives the rotatable object. The arrangement remains nonetheless watertight.

In the state in which the tent is not set up, the central post is first only connected to the device at its end which is at the top in the set-up state, while its end which is at the bottom in the set-up state of the tent is loose. Regardless thereof, however, the central post is connected to the four-way connector, i.e. to a part of the supporting framework.

In the present invention, the hollow central post, which is part of the preferably foldable roof structure, and which ends in the apex of the roof, is shaped as an octagonal aluminum tube. Other basic geometrical shapes and materials can also be used.

In particular, the central post can be a corner support of the supporting structure shortened to the desired dimensions. The explanations given above with regard to the supporting structure also apply analogously to the central post.

The diameter of the central post for folding tents is typically 30-100 mm, preferably 50 mm. In addition, the octagonal profile of the central post and a wall thickness of 1-5 mm, preferably 2 mm, ensure even greater stability of the tent structure.

These details are merely given by way of example and depend on the respective intended use of the tent. In the case of an emergency shelter tent, for example, different dimensions and thicknesses are required than in the case of a mere garden tent.

As explained above based on the example of a tent measuring 5×5 m, which has three circumferential scissor-type grid sections of the roof structure on each side, such structures lack a center or junction point of the tent extending from the same scissor-type grid sections, i.e. these scissor-type grid sections are not the direct starting point for profiles extending therefrom towards the inside of the tent and running towards a central post arranged in the middle of the tent, which receives the apex of the roof.

Accordingly, the invention provides the arrangement of the four central diagonal bars mentioned above. These diagonal bars are automatically brought into position by pulling the tent apart and thus also effect the central positioning of the central post, as is described in more detail below. The diagonal bars are hinged to the four four-way connectors described above, which are diagonally spaced apart from each other and form a square arrangement.

Instead of the preferred diagonal bars, ropes, belts or chains can also be used.

As explained above, these connectors are used to hinge further scissor-type grid sections running inwards into the tent, which are aligned directly with the outer scissor-type grid sections running on the outer side of the supporting framework, and which are connected to these scissor-type grid sections. The scissor-type grid sections are arranged between the connectors. Thus, the structural connection between the central post and the outer scissor-type grid sections running circumferentially around the outer sides is achieved by means of the central diagonal bars and the scissor-type grid sections directed inwards into the tent. The connection between the central diagonal bars and the scissor-type grid sections directed inwards into the tent is achieved by means of connectors having a cross-shaped configuration. In the case of a square floor plan of a tent, this structure provides the division into nine square partial floor plans as already mentioned above.

The four central diagonal bars are connected to the central post by means of a central connector. The four central diagonal bars are preferably hinged to the central connector in a manner known per se. In its center, this connector is provided with a hollow space, into which the lower portion of the central post is inserted. In a manner to be described in more detail below, the connector thus acts as a guide or motion link for the central post. Together with the central post, the central diagonal bars are moved upwards when the tent is set up so that the final apex of the tent roof is formed and the tent assumes the pyramid-shaped or pagoda-shaped tent roof shape.

A difference to the classic folding tents, in which the central post is raised by setting up the tent or by pushing up a guiding device or a motion link so that the apex of the tent roof also moves upwards, lies in the following:

As described above, the central post is attached to the apex of the tent roof by means of a device. The central post preferably has a length which makes it easy to transport in motor vehicles, station wagons or the like.

When the tent is set up, the central post still hangs loosely down from this device.

For the further setting up of the tent and for the purpose of obtaining the pyramid-shaped or pagoda-shaped tent roof structure, a handling bar is provided according to the invention, which is inserted from below into the hollow space 10 of the central post via the aforementioned connector.

The resulting overall connecting structure consisting of the central post and the handling bar is then pushed upwards manually or mechanically, for example by means of a wire rope hoist, a crank, a thread, toothed racks, a worm gear, or by a motor.

A corresponding opening in the central post or handling bar is then used to press in a spring-loaded bolt inserted therein, referred to below in simplified terms as spring bolt, which snaps into a corresponding recess in the guide of the connector as soon as there is a local overlap of these areas. This lock can be released again by means of a push button. In order to facilitate operation, the handling bar has a hand knob.

This combination enables a considerably larger height arrangement of the apex of the roof.

In addition, this structure enables such tents to be configured in the form of folding tents, and it is no longer necessary to assemble or screw together such tents, especially pagoda tents, in a time-consuming manner, as was previously the case.

The handling bar is therefore an essential aspect of the invention, which goes beyond the mere extension of the central post.

In addition, this enables a considerable reduction in packing height or overall height in the delivery state. Furthermore, large height of a tent roof exceeding the height of normal cone-shaped tent roof structures is achieved, in particular the configuration of a pagoda-shaped tent roof.

In an additional embodiment of the supporting framework of a tent according to the invention, stabilizer devices are also provided, which are described below:

As already described above, the outer scissor-type grid sections of the supporting framework running on the outer side of the tent are connected to each other by means of connectors at the top and connectors at the bottom arranged on the profile elements of the scissor-type grid sections so that the tent has a circumferential scissor-type grid arrangement on all sides.

As described above, the scissor-type grid sections directed inwards into the tent and extending from the connectors of the central diagonal bars are also arranged on the upper and lower connectors. As three-way connectors, these connecting elements have thus a T-shaped configuration. They are arranged at the respective upper and lower end of the profile elements of the outer scissor-type grid section crossing each other and receive the respective upper and lower end of the profile elements of the adjacent outer scissors-type grid section crossing each other. The reception can be a hinge, for example. At the same time, the upper and lower three-way connectors receive the upper and lower ends of the scissor-type grid sections which are directed inwards into the tent and extending therefrom, for example also by means of a hinge.

In the area of these upper and lower connectors, the scissor-type grid profiles of the circumferential outer scissor-type grid sections of the supporting framework as well as those directed inwards into the tent reach their maximum spacing at the distance "d".

This area of their maximum spacing serves to arrange stabilizer devices. These stabilizer devices serve to provide improved stability of the tent by connecting the scissor-type grids via the stabilizer devices at their greatest distance "d" In a conventional tent, the scissor-type grids themselves are not connected to each other. In the present type of tent, however, the forces would be so great that the profile elements of the scissor-type grid arrangement running at the bottom would be pushed downwards when the tent is set up.

The stabilizer devices are advantageous, because the tent roof directs the forces acting downwards via the central diagonal bars described above to the outer side, and this is where the corresponding force should be absorbed. The application of force would push the lower scissors of the scissor-type grid downwards.

For this purpose, the scissor-type profile elements of the scissor-type grid sections running upwards and running downwards are connected to each other in the area of their greatest spacing "d". Two connecting tubes are provided for this purpose, namely a connecting tube at the top and a connecting tube at the bottom.

In the example case of a tent measuring 5×5 m, the stabilizer devices are thus each arranged between the connectors configured in the form of corner connectors and enclosed between the upper connectors and the lower connectors, each having the upper connecting tubes and the lower connecting tubes, as is further described below.

The stabilizer devices are configured in the manner described above and below; however, they could also be configured in any other technical manner, for example in the form of chains, tension belts or other fastening means, which are synonyms for the term "stabilizer device" within the meaning of the present invention.

The stabilizer devices are thus connected indirectly via the scissor-type grid sections directed inwards into the tent and indirectly the central diagonal bars to the central post or the handling bar for the central post.

This causes a more or less fanned-out application of force starting from the central post or the handling bar inside the tent towards the outer side of the tent.

The two connecting tubes thus interact with the aforementioned upper connectors and the lower connectors, which are not only connectors for the outer scissor-type grid sections running circumferentially around the outer sides of the tent, but which are also (indirect) connectors to the central post or the handling bar.

The (respective) lower connecting tube is guided in a lower connector, which is movable. The lower connector has a tubular configuration, i.e. it forms a guide or motion link for the lower connecting tube. The connecting tube can be guided in a movable manner through the tubular hollow space of the lower connector, which is preferably configured in the form of a cylindrical hollow space.

It is pushed upwards by means of a hand knob arranged at the lower end of the lower connecting tube through the hollow space of the connector, and connected by means of a connecting part, in which a protruding spring bolt is mounted, to the upper connecting tube, preferably via an opening provided therein, into which the spring bolt snaps when it reaches the opening as a result of pushing the lower connecting tube upwards.

In order to release this connection between the two connecting tubes thereby occurring, a push button may be provided, by means of which the spring bolt can be pushed back into the lower connecting tube so far that it can, for example, be pulled out of the upper connecting tube with a larger diameter again, or the spring bolt is pushed back through the opening with the thumb to release the connection.

As soon as the tent is set up in its basic form, which is the case when the handling bar of the central post has brought the latter into its final position, the stabilizer devices are used as described above, i.e. the tubes are connected to each other.

As described above, the handling bar is a separate component when compared to the central post. However, it can also be configured in the form of a telescopic device, which is arranged at least in sections in the hollow space of the central post. In this case, the central post has a larger diameter than the handling bar in its configuration in the form of a telescopic device, i.e. the central post overlaps the telescopic component, which in turn is fixed to the connector in its extended state.

In its configuration in the form of a telescopic device, the handling bar also serves to adjust the height of the central post, for the purpose of which it can be moved out of the central post to the desired extent. The relative axial fixing of the central post and the handling bar as a telescopic device as well as the movability of the telescopic device can be carried out in various ways known in the state of the art. By using such a configuration of the handling bar in the form of a telescopic device, it is thus also possible to shorten the central post to a manageable length for transport or storage purposes, for example, while in the position of use, the central post can simply be extended so far that the fabric of the tent roof is arranged at a sufficient height above the ground.

BRIEF DESCRIPTION OF THE DRAWINGS

For a better understanding of the present invention, reference is made exclusively for the purpose of exemplary illustration and without any restrictive effect to the figures below, which show the following.

DETAILED DESCRIPTION

Figure 1:
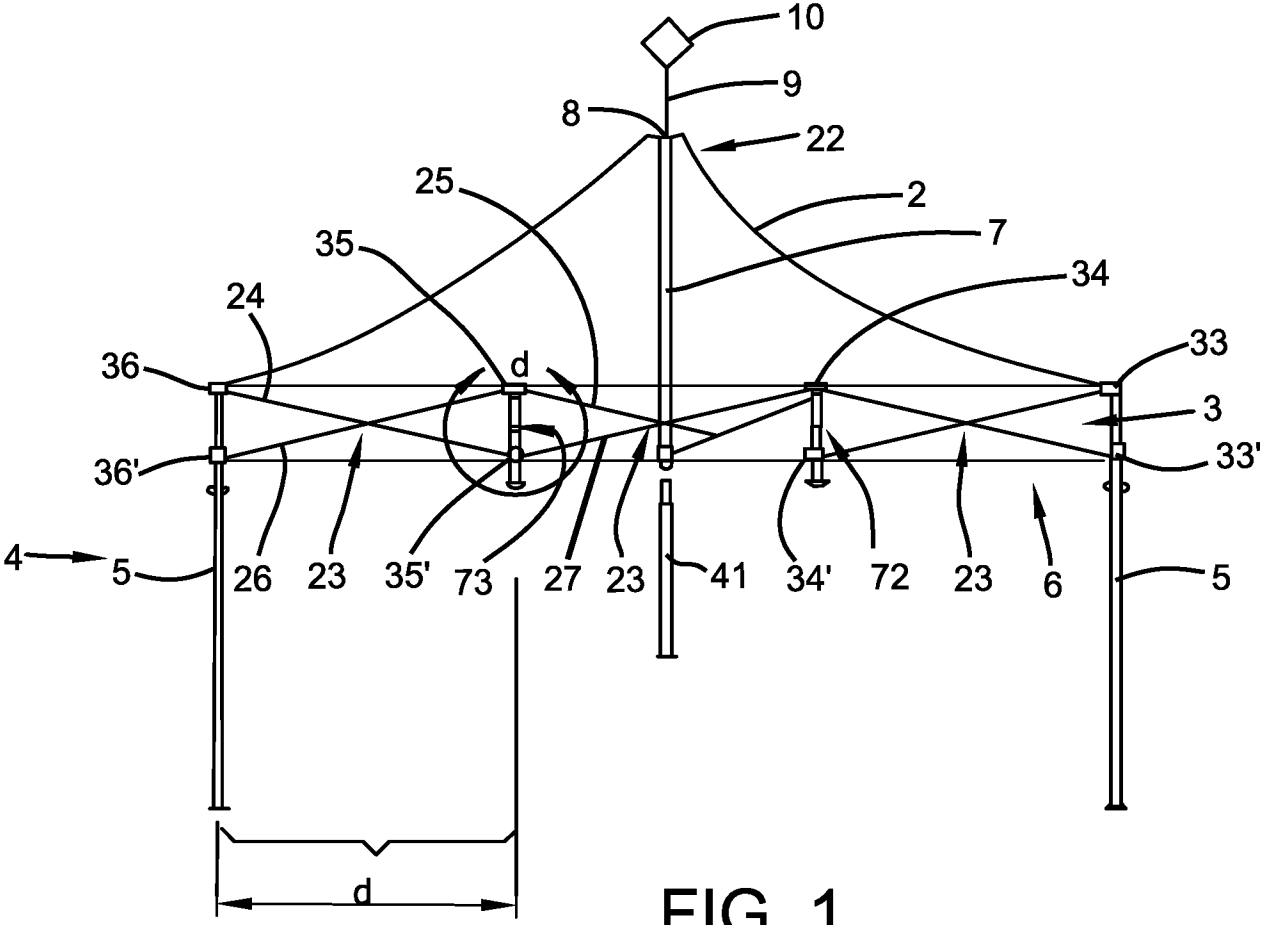
FIG. 1: a schematic diagram of a tent with a tent roof in diagonal view.

As shown in FIG. 1, the roof structure of the tent rests on the end of the supports 5 which is at the top in the set-up state of the tent. In the case of a square tent structure, the four respective corner areas of the tent roof are therefore disposed on the supports 5 correspondingly arranged in a square.

The supports 5 are connected to each other via L-shaped connecting elements. As shown in FIG. 1, at least three outer scissors-type grid sections 23 run on each outer side of an exemplary square tent structure according to the invention. The supports 5 are thus connected to each other by means of scissor-type grid sections 23.

The outer scissor-type grid sections 23 running circumferentially around the outer sides of the supporting framework 6 as well as the scissor-type grid sections 23' directed inwards into the tent in turn are connected to each other by means of a plurality of upper and lower connecting elements 34, 34'; 35, 35' (the numerals 28, 28'; 29, 29' mentioned in the text are not shown in FIG. 1), which are illustrated by way of example in FIG. 1. If three scissor-type grid sections are arranged on one side, at least two upper and lower connecting elements are thus provided for the connection between the outer scissor-type grid sections 23 and the scissor-type grid sections 23' directed inwards into the tent.

Figure 2:
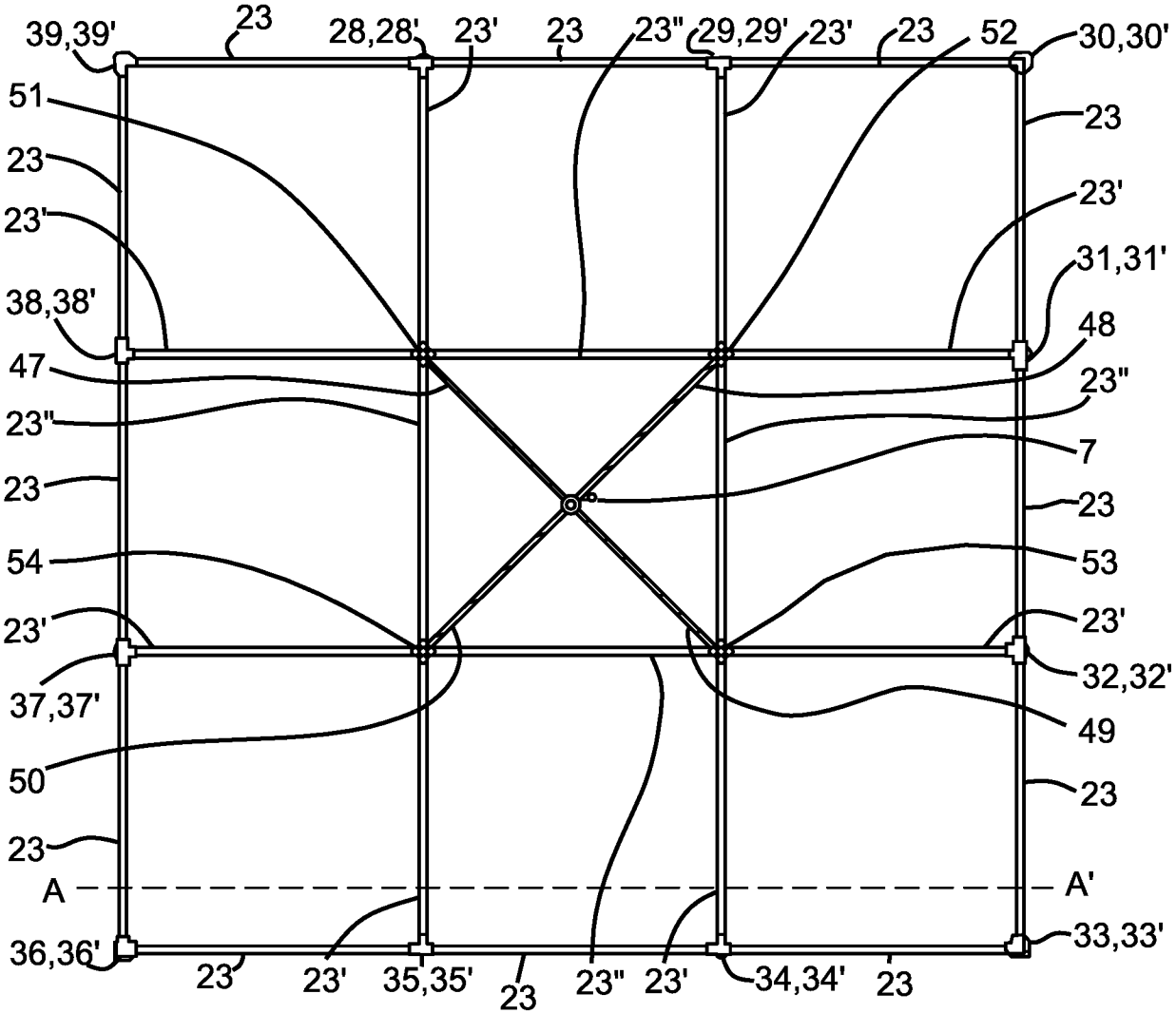
FIG. 2: a schematic diagram of the arrangement of the connectors, the central diagonal bars and the inner profile elements as well as the circumferential scissor-type grid sections as viewed from above.

When looking at one side of the supporting framework according to the present invention in FIG. 1, in sectional view A-A' according to FIG. 2, it has a corner support 5 on each of its outer sides, FIG. 1. The corner supports 5 are connected to each other by means of at least three scissor-type grid sections 23. The corner support 5 which is on the left when viewed from the front is first connected to the adjacent scissor-type grid section 23 by means of an upper and lower connecting element 36, 36'. This scissor-type grid section 23 is then followed by a second scissor-type grid section 23, with the connection 35, 35' these two sections in turn being made by means of a connecting element having a T-shape in a preferred embodiment. The third scissor-type grid section 23 is arranged adjacent thereto, which in turn is connected to the second scissor-type grid section 23 by means of a preferably T-shaped connecting element 34, 34'. Then the third scissor-type grid section 23 in turn is connected to the corner support 5 which is on the right when viewed from the front by means of a further upper and lower connecting element 33, 33'.

Viewed individually, each side of the supporting framework thus has four upper and four lower connecting elements.

Since this is a scissor-type grid structure, a corresponding number of lower connecting elements is added, because the connecting elements are arranged at the point where one scissor-type profile has its maximum spacing of its profile elements and is connected to the adjacent scissor-type profile, where this scissor-type profile also has its maximum distance in its connecting area. Here, this distance, which is at its maximum in the pulled-apart state of the scissor-type grid section, is abbreviated with "d", cf. FIG. 1.

The connecting elements used within the scope of the invention preferably have a T-shaped receiving structure for the connection of the outer scissor-type grid sections 23 to each other. This is indicated in FIG. 2 with the pairs of numerals 28, 28'; 29, 29'; 31, 31'; 32, 32'; 34, 34'; 35, 35'; 37, 37'; 38, 38', with the scissor-type profile elements running essentially parallel to the respective side of the tent. The numerals 28', 29', 31', 32', 34', 35', 37', 38' with an apostrophe stand for the lower connecting elements. The numerals 28, 29, 31, 32, 34, 35, 37, 38 indicate the upper connecting elements. Scissor-type grid sections 23' directed inwards into the tent branch off from these connecting elements, which are also referred to as three-way connectors. The connecting elements are thus not aligned with a two-dimensional course, which would be sufficient for a connection of the scissor-type grid sections to each other, but they have a receiving structure branching off therefrom at a right angle, which receives the profile elements of the scissor-type grid sections 23' running towards the inside of the tent.

As described above, the scissor-type grid sections 23' directed inwards into the tent and extending from the connectors 51-54, 51' 54' of the central diagonal bars 47-50 are also arranged at the positions 28, 28', 29, 29', 29', 31, 31', 32, 32', 34, 34', 35, 35', 37, 37' and 38, 38'. As three-way connectors, the connecting elements 28, 28', 29, 29', 31, 31', 32, 32', 34, 34', 35, 35', 37, 37' and 38, 38' thus have a T-shaped configuration. They are located at the point where the respective scissor-type grid profile 23 is at its highest position, FIG. 1.

At the respective position located vertically at the bottom, the arranged scissor-type profile also reaches its lowest position.

Figure 7:
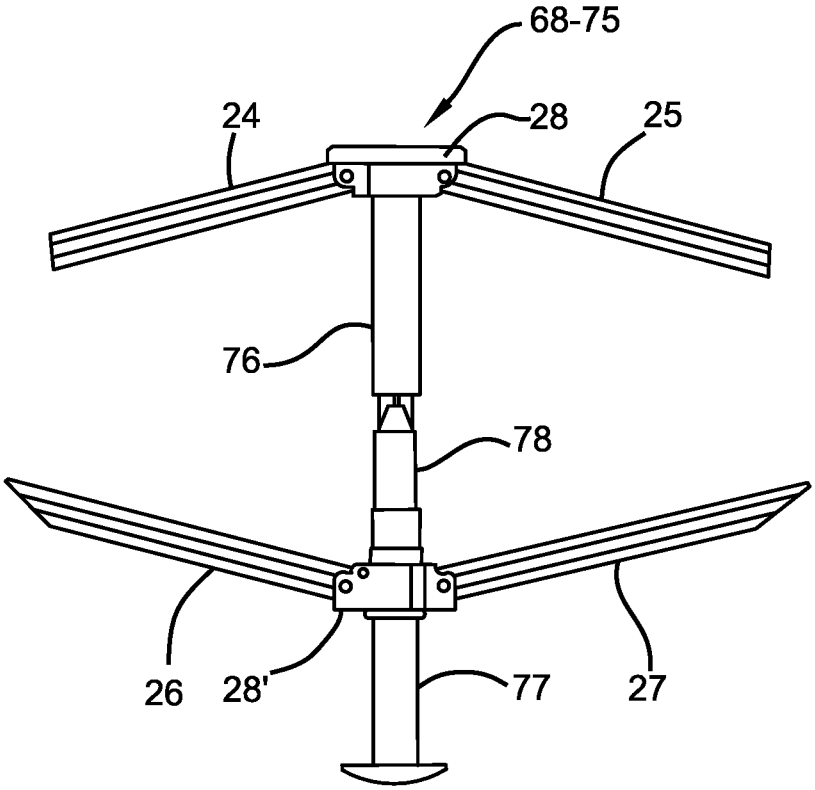
FIG. 7: a schematic diagram of a stabilizer device.

The lower scissor-type grid elements 26, 27 of the outer scissors 23 shown in FIG. 1, which run from bottom left to top, are hinged to the upper connectors 35 and 34; and, as shown in FIG. 7 are hinged with regard to the pair of connectors 28, 28'. The scissor-type grid elements 24, 25, which run from top left to bottom, are hinged to the lower connectors 35' and 34', which are likewise configured in a T-shape analogous to the connectors 35, 34 arranged at the top. The scissor-type grid sections 23' further branch off from these T-shaped connectors towards the connectors 51-54, which provide a connection also of these scissor-type grid sections 23' to the central diagonal bars 47-50, FIG. 2, FIG. 4, FIG. 5. The scissor-type grid section 23 comprises profile elements 24, 26, 25, 27 (shown in FIG. 1 by way of example) extending at an angle to each other, hinged together and crossing each other, which are brought into contact with each other substantially vertically in a folded state.

The connectors of the corner supports 5 with the scissor-type grid sections 23, namely the connectors 30, 30'; 33, 33'; 36, 36'; 39, 39', have a so-called L-shape as shown in FIG. 2.

These connectors serve to connect the outer scissor-type grid sections 23 at an angle. Here, too, the reference numerals 30', 33', 36', 39' with an apostrophe stand for the lower connecting elements, while the numerals 30, 33, 36, 39 refer to the upper connecting elements.

The inner upper connecting elements 51, 52, 53, 54 and the inner lower connecting elements 51', 52', 53', 54' are configured in the form of four-way connectors or cross-shaped connectors, since, on the one hand, they connect the profile elements of the scissor-type grid sections 23' directed inwards into the tent at the point where they run towards each other in a crosswise manner when branching off from the respective adjacent outer sides. On the other hand, they receive the four inner scissor-type grid sections 23", which are aligned to each other in a rectangular manner, cf. FIG. 2.

The four inner scissor-type grid sections 23" are a kind of square, in the center of which the central post 7 is located. The central post 7 in turn is connected to the four-way connectors described above via four central diagonal bars 47, 48, 49, 50, FIG. 2, FIG. 4, with a connection to the upper connectors 51, 52, 53, 54 being suitable.

In the set-up state, in which the tent roof rises in its highest elevation above the supports of the supporting framework of the tent, the profile elements extend in a scissor shape beneath the tent roof as shown in FIG. 1 and FIG. 7. Due to the screen 3 of the fabric of the tent roof 2, the scissor-type grid sections 23 are not visible to the viewer.

Figure 4:
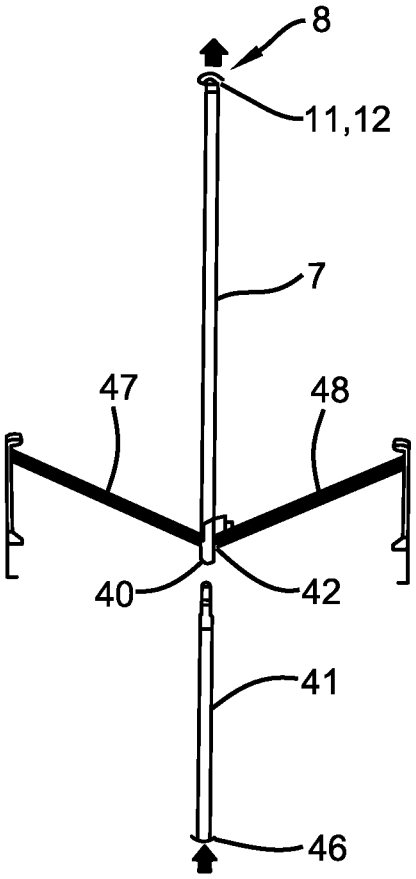
FIG. 4: a schematic diagram of the central post, the handling bar and the connection of both as well as two central diagonal bars.
Figure 5:
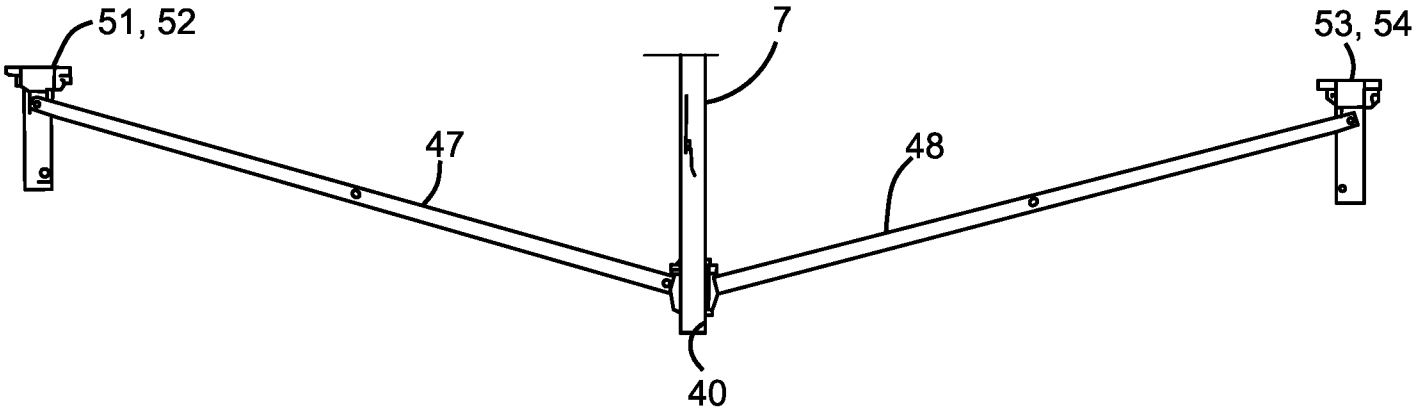
FIG. 5: a detailed view of FIG. 4.

The supporting framework 6 arranged inside the tent, i.e. the roof structure of the tent, in turn has at least one central post 7, which has an indirect support in the roof structure, FIG. 1 and FIG. 4.

The central post 7 is directed towards the fabric 2 of the tent roof and holds it directly so that the apex 22 of the tent roof fabric is located as far away as possible from the remaining structure of the supporting framework. This results in the typical pyramid-like or pagoda-like tent roof structure, FIG. 1.

Figure 9:
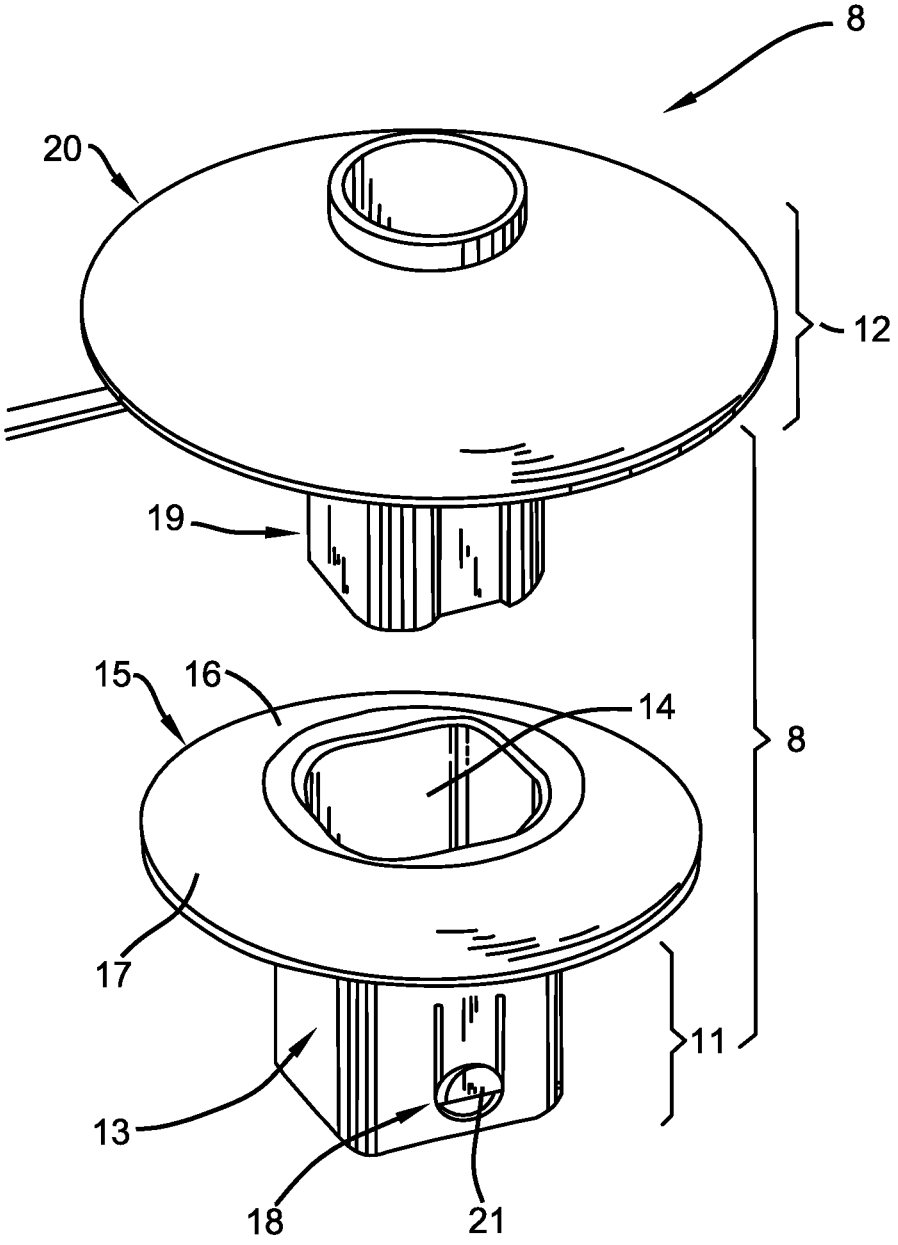
FIG. 9: a schematic diagram of the device for attaching the fabric of the tent roof to the central post.

As shown in FIG. 9, a device 8, which serves to firmly connect the fabric of the tent roof 2 to the central post 7, is connected to this central post.

This device preferably has a closing mechanism on the upper front side of the apex of the tent roof in order to seal this area in a watertight manner.

The device 8 comprises a first body 11, which serves to be connected to the central post, and a second body 12, which serves to be connected to the first body 11. The latter directly holds the fabric of the tent roof 2, which is inserted between the two bodies 11 and 12. For the connection between the two bodies, the fabric of the tent roof 2 has an opening, which is surrounded by a rigid ring (not shown) bordering the edge of this opening. This ring is thus inserted between the aforementioned bodies 11 and 12 in such a manner that a connection between them is made possible. However, other related structures are easily possible for the person skilled in the art.

In particular, the first body 11 has a substantially mushroom-shaped form and comprises a vertically running wall, which preferably has a tubular configuration 13 and surrounds a hollow space 14. This first body 11 serves to be fitted into the central post 7 and to be inserted into its hollow space by means of the wall of the tube 13. The first body 11 can be pulled out of the central post again.

After the first body 11 has been inserted into the central post 7, the ring of the fabric of the tent roof 2 slides over the head of this body. The ring rests, in particular, on the flat portion 16 of the head 15, which otherwise has a curved configuration 17.

The first body 11 is connected to the second body 12, which also has a substantially mushroom-shaped configuration. The second body 12 also comprises a vertically running wall of a tube 19 surrounding a hollow space.

At the head end of the wall of the tube 19 of the second body 12, a cylinder cap is arranged, which serves to cover the ring of the fabric of the tent roof 2 and to interact with a lid in a manner known per se so as to close the hollow space inside the second body 12. Thus, this lid also serves indirectly to close the hollow space of the central post 7 when it is in a state of non-use, for example, so that rain, dust or other substances cannot penetrate into the hollow space.

If required, a further component, for example a pole 9, which receives a rotatable object 10 or an advertising banner, can be placed, for example inserted, into the hollow space as indicated in FIG. 1.

The essential point about a folding tent is that due to the aforementioned structure, the roof can be penetrated from above with the further pole 9, which receives the rotatable object 10. The arrangement remains nonetheless watertight.

In the state in which the tent is not set up, the central post 7 is first only connected to the device 8 at its end which is at the top in the set-up state, while its end which is at the bottom in the set-up state of the tent is loose, FIG. 4. Regardless thereof, however, the central post is connected to the four-way connector, i.e. to a part of the supporting framework.

Figure 3:
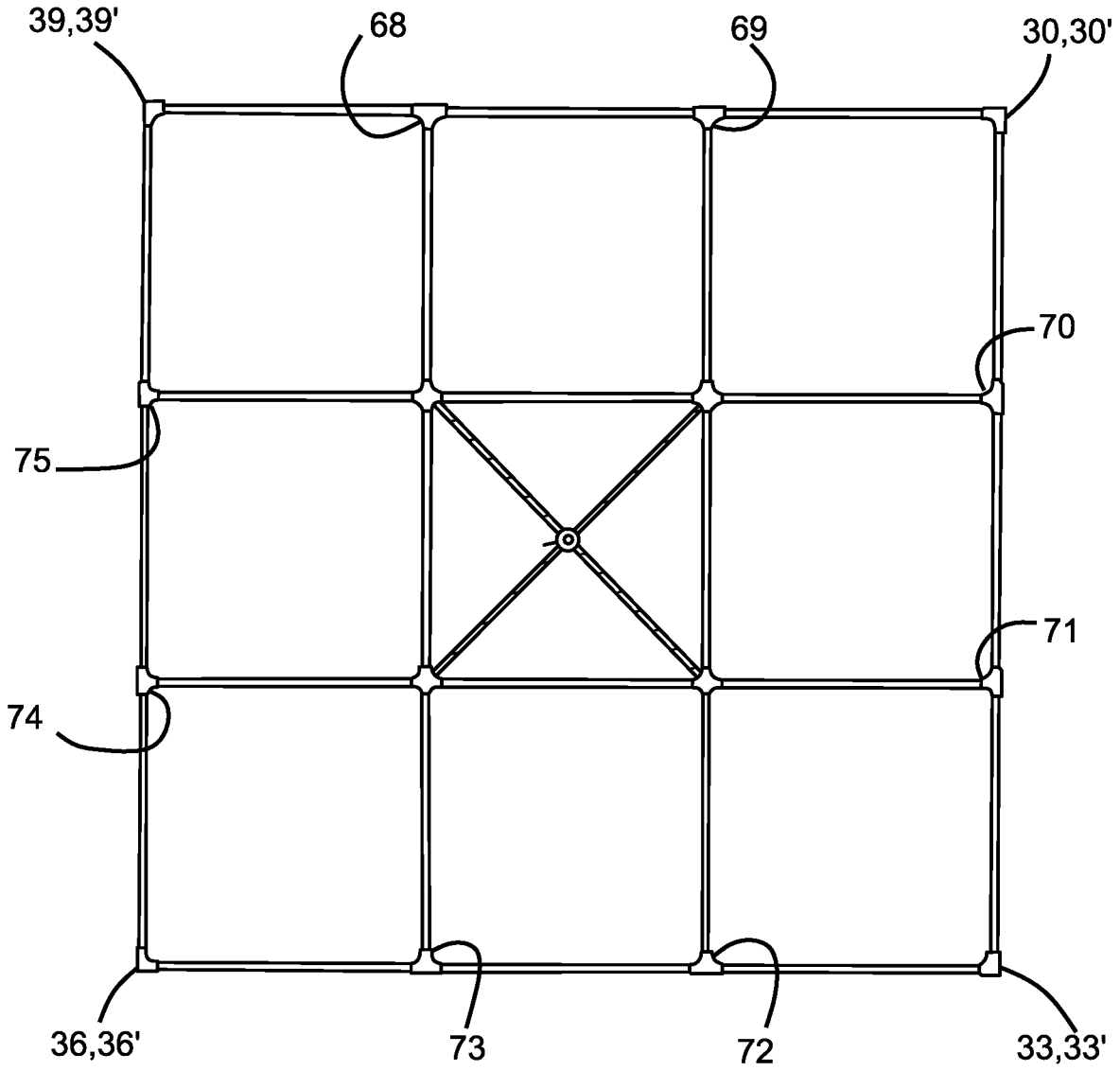
FIG. 3: a schematic diagram of the arrangement of the stabilizer devices as viewed from above.

As can be seen in FIG. 2 and FIG. 3 based on the example of a tent measuring 5×5 m, which has three circumferential scissor-type grid sections 23 of the roof structure 6 on each side, such structures lack a center or junction point of the tent extending from the same scissor-type grid sections, i.e. these scissor-type grid sections are not the direct starting point for profiles extending therefrom towards the inside of the tent and running towards a central post arranged in the middle of the tent, which receives the apex of the roof.

Accordingly, the invention therefore provides the arrangement of the four central diagonal bars 47-50, FIG. 2. These diagonal bars are automatically brought into position by pulling the tent apart and thus also effect the central positioning of the central post 7, as is described in more detail below. As already described above, the diagonal bars are hinged to four four-way connectors 51-54, 51'-54', which are diagonally spaced apart from each other and form a square arrangement, FIG. 2.

As mentioned above, the upper connectors 51-54 and the lower connectors 51'-54' each are connected via the four-way connectors 51, 51', 52, 52', 53, 53', 54, 54' to the scissor-type grid sections 23' directed inwards into the tent, which in turn are hinged to the outer scissor-type grid sections 23.

Thus, the structural connection between the central post 7 and the outer scissor-type grid sections 23 running circumferentially around the outer sides is achieved by means of the central diagonal bars 47-51 and the scissor-type grid sections 23' directed inwards into the tent. In the case of a square floor plan of a tent, this structure provides the division into nine square partial floor plans as already mentioned above, FIG. 2, FIG. 3.

Figure 6:
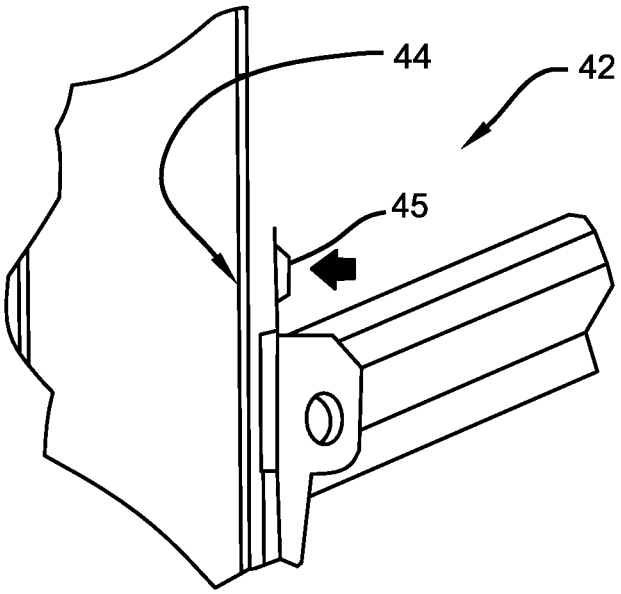
FIG. 6: a schematic diagram of the connection between the handling bar and the central post in detail.

The four central diagonal bars 47-50 are connected to the central post 7 by means of a central connector 42, FIG. 1, FIG. 4, FIG. 6. The four central diagonal bars are hinged to the central connector 42 in a manner known per se. In its center, this connector is provided with a hollow space, into which the lower portion of the central post 7 is inserted. The connector 42 thus acts as a guide or motion link for the central post 7. Together with the central post 7, the central diagonal bars 47-50 are moved upwards when the tent is set up so that the final apex of the tent roof is formed and the tent assumes the pyramid-shaped or pagoda-shaped tent roof shape.

When the tent is set up, the central post 7 still hangs loosely down from the device 8, cf. FIG. 4.

For the further setting up of the tent and for the purpose of obtaining the pyramid-shaped or pagoda-shaped tent roof structure, a handling bar 41 is provided according to the invention, which is inserted from below into the hollow space 40 of the central post 7 via the aforementioned connector 42, FIG. 1, FIG. 4.

The resulting overall connecting structure consisting of the central post 7 and the handling bar 41 is then pushed upwards manually or mechanically, for example by means of a wire rope hoist, a crank, a toothed rack, a gearing mechanism, or by a motor.

A corresponding opening 44 in the central post 7 or handling bar 41 is then used to press in a spring-loaded bolt (not shown) inserted therein, referred to below in simplified terms as spring bolt, which snaps into a corresponding recess in the guide of the connector 42 as soon as there is a local overlap of these areas. This lock can be released again by means of a push button 45, FIG. 6. In order to facilitate operation, the handling bar 41 has a hand knob 46, FIG. 4.

This combination enables a considerably larger height arrangement of the apex of the roof.

As already described above, the scissor-type grid sections 23 of the supporting framework 6 running on the outer side of the tent are connected to each other by means of connectors at the top 28-39 and connectors at the bottom 28'-39' arranged on the profile elements of the scissor-type grid sections 23 so that the tent has a circumferential scissor-type grid arrangement on all sides, FIG. 1, FIG. 2.

It has already been described above that in the area of the upper and lower connectors 28, 28'; 29, 29'; 31, 31'; 32, 32';

34, 34'; 35, 35'; 37, 37' and 38, 38', the scissor-type grid profiles of the circumferential scissor-type grid sections 23 of the supporting framework 6 reach their maximum spacing at the distance "d" if and insofar as they are in the pulled-apart state, FIG. 1.

This area of their maximum spacing serves to arrange stabilizer devices 68-75, FIG. 3. These stabilizer devices serve to provide improved stability of the tent by connecting the scissor-type grids via the stabilizer devices at their greatest distance "d".

For this purpose, the scissor-type profile elements of the scissor-type grid sections 23 running at the top and running at the bottom are connected to each other in the area of their maximum spacing "d". Two connecting tubes are provided for this purpose, namely a connecting tube at the top 76 and a connecting tube at the bottom 77, cf altogether FIG. 1, FIG. 7.

Therefore, in the example case of a tent measuring 5×5 m, the stabilizer devices 68-75 are each arranged between the connectors 30, 30', 33, 33', 36, 36', 39, 39' configured in the form of corner connectors and enclosed between the upper connectors 28, 29, 31, 32, 34, 35, 37 and 38 and the lower connectors 28', 29', 31', 32', 34', 35', 37' and 38', and each have the upper connecting tubes 76 and the lower connecting tubes 77, as is further described below, FIG. 2, FIG. 3.

In addition, the stabilizer devices 68-75 are connected to the central post 7 or the handling 41 bar for the central post 7 by means of the scissor-type grid sections 23' and the central diagonal bars 47-50.

This causes a more or less fanned-out application of force starting from the central post 7 or the handling bar inside the tent towards the outer side of the tent.

The two connecting tubes 76 and 77 thus interact with the aforementioned upper connectors and the lower connectors, which are not only connectors for the outer scissor-type grid sections 23 running circumferentially around the outer sides of the tent, but which are also (indirect) connectors to the central post 7 or handling bar 41, FIG. 2, FIG. 3, FIG. 7.

Figure 8:
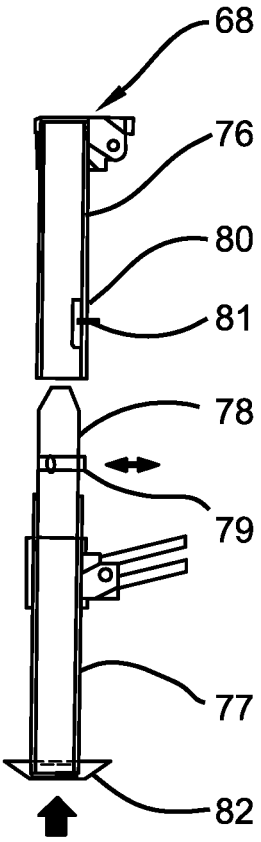
FIG. 8: a detailed view of the connection of a stabilizer device.

The (respective) lower connecting tube 77 is movable in a lower connector 28', 29', 31', 32', 34', 35', 37', 38'. The lower connector has a tubular configuration, i.e. it forms a guide or motion link for the lower connecting tube 77. The connecting tube 77 can be guided in a movable manner through the tubular hollow space of the lower connector, which is preferably configured in the form of a cylindrical hollow space, FIG. 7, FIG. 8.

It is pushed upwards by means of a hand knob 82 arranged at the lower end of the lower connecting tube 77 through the hollow space of the connector 28', 29', 31', 32', 34', 35', 37', 38', and connected by means of a connecting part 78, in which a protruding spring bolt 79 is mounted, to the upper connecting tube 76, preferably via an opening 80 provided therein, into which the spring bolt 79 snaps when it reaches the opening 80 as a result of pushing the lower connecting tube 77 upwards.

In order to release this connection between the two connecting tubes 76, 77 thereby occurring, a push button 81 may be provided, by means of which the spring bolt 79 can be pushed back into the lower connecting tube so far that it can, for example, be pulled out of the upper connecting tube 76 with a larger diameter again, or the spring bolt 79 is pushed back through the opening 80 with the thumb to release the connection.

As soon as the tent is set up in its basic form, which is the case when the handling bar 41 of the central post 7 has brought the latter into its final position, the stabilizer devices 68-75 are used as described above, i.e. the tubes 76, 77 are connected to each other.

LIST OF REFERENCE NUMERALS 1. tent, pagoda tent
2. fabric of the tent roof
3. screen of the tent roof
4. supporting structure
5. support, corner support
6. supporting framework, roof structure of the tent roof
7. central post
8. device for attaching the fabric of the tent roof to the central post
9. pole
10. rotatable object, advertising banner
11. first body
12. second body
13. tube of the first body
14. hollow space of the tube 13
15. head of the first body
16. flat head 15
17. curved head 15
18. opening in the tube 13
19. tube of the second body
20. head of the second body
21. push button for snapping into 18
22. apex of the roof
23. outer scissor-type grid section
23'. scissor-type grid sections directed inwards into the tent
23". inner scissor-type grid sections
24. outer scissors at the top
25. outer scissors at the top
26. outer scissors at the bottom
27. outer scissors at the bottom
28. connector of the outer scissors at the top
28'. connector of the outer scissors at the bottom
29. connector of the outer scissors at the top
29'. connector of the outer scissors at the bottom
30. connector of the outer scissors at the top
30'. connector of the outer scissors at the bottom
31. connector of the outer scissors at the top
31'. connector of the outer scissors at the bottom
32. connector of the outer scissors at the top
32'. connector of the outer scissors at the bottom
33. connector of the outer scissors at the top
33'. connector of the outer scissors at the bottom
34. connector of the outer scissors at the top
34'. connector of the outer scissors at the bottom
35. connector of the outer scissors at the top
35'. connector of the outer scissors at the bottom
36. connector of the outer scissors at the top
36'. connector of the outer scissors at the bottom
37. connector of the outer scissors at the top
37'. connector of the outer scissors at the bottom
38. connector of the outer scissors at the top
38'. connector of the outer scissors at the bottom
39. connector of the outer scissors at the top
39'. connector of the outer scissors at the bottom
40. hollow space of the central post 7
41. handling bar for 7
42. connector for 7, 41 (used with a spring bolt (not shown))
44. opening for the spring bolt (not shown) in the central post 7

45. push button
46. hand knob for 41
47. central diagonal bar
48. central diagonal bar
49. central diagonal bar
50. central diagonal bar
51. connector of the central diagonal bar
51'. lower connector of the central diagonal bar
52. connector of the central diagonal bar
52'. lower connector of the central diagonal bar
53. connector of the central diagonal bar
53'. lower connector of the central diagonal bar
54. connector of the central diagonal bar
54'. lower connector of the central diagonal bar
55. remains unassigned
56. remains unassigned
57. remains unassigned
58. remains unassigned
59. remains unassigned
60. remains unassigned
61. remains unassigned
62. remains unassigned
63. remains unassigned
64. remains unassigned
65. remains unassigned
66. remains unassigned
67. remains unassigned
68. stabilizer device
69. stabilizer device
70. stabilizer device
71. stabilizer device
72. stabilizer device
73. stabilizer device
74. stabilizer device
75. stabilizer device
76. connecting tube at the top for 68-75
77. connecting tube at the bottom for 68-75
78. connecting area for 76, 77
79. spring bolt for 78
80. opening in 76 for 79
81. push button for 80 in 76
82. hand knob for 77

The invention claimed is:

1. A supporting framework of a tent with
a roof having a pyramid shape,
a supporting structure comprising at least four supports,
at least three outer scissor-type grid sections for each outer side of the supporting framework,
a device for attaching the roof to a central post,
central diagonal bars extending from the central post,
two sets of interior scissor-type grid sections, each set extending orthogonally inward from and coupled with and between a pair of opposing outer sides of the supporting framework;
characterized in that
respective central diagonal bars are connected to at least two different interior scissor-type grid sections, and that
the central post is extended by means of a handling bar for the formation of an apex of the roof, and that
the handling bar or the central post can be connected to the central diagonal bars.

2. The supporting framework according to claim 1, characterized in that the central diagonal bars are attached to the central post or the handling bar by means of a connector, wherein the connector has a guide or motion link, through which the central post or the handling bar is guided.

3. The supporting framework according to claim 1, characterized in that the tent is a folding tent.

4. The supporting framework according to claim 1, characterized in that the tent is a pagoda tent.

5. The supporting framework according to claim 1, characterized in that the central diagonal bars are connected via connectors to the interior scissor-type grid sections, which in turn are connected to the outer scissor-type grid sections running circumferentially around the outer sides of the supporting framework.

6. The supporting framework according to claim 1, characterized in that the ends directed inwards into the tent of the interior scissor-type grid sections directed inwards into the tent are connected to each other via inner scissor-type grid sections.

7. The supporting framework according to claim 1, characterized in that each scissor-type grid section of the outer sides comprises an upper scissor-type element and a lower scissor-type element, and adjacent scissor-type grid sections are coupled at the upper scissor-type elements and the lower scissor-type elements of the adjacent grid section, and the coupled upper scissor-type elements are connected to the lower scissor-type elements by at least one stabilizer device when the adjacent, coupled scissor-type grid sections are expanded to a distance "d".

8. The supporting framework according to claim 7, characterized in that the at least one stabilizer device has an upper connecting tube and a lower connecting tube, which can be connected to each other.

9. The supporting framework according to claim 8, characterized in that the connection of the upper connecting tube and the lower connecting tube is a push-in connection.

10. The supporting framework according to claim 9, characterized in that the push-in connection has a spring-loaded bolt and a device for releasing the spring-loaded bolt.

11. A tent with a supporting framework, characterized in that the supporting framework is configured according to claim 1.

12. A tent with a supporting framework, characterized in that the supporting framework is configured according to claim 8.

* * * * *